US009523561B2

(12) United States Patent
Di Mauro Lorenzi

(10) Patent No.: US 9,523,561 B2
(45) Date of Patent: Dec. 20, 2016

(54) FIREARMS LOCALIZATION AND DESTRUCTION SYSTEM

(71) Applicant: Anibal Di Mauro Lorenzi, Departamento de Maldonado (UY)

(72) Inventor: Anibal Di Mauro Lorenzi, Departamento de Maldonado (UY)

( * ) Notice: Subject to any disclaimer, the term of this patent is extended or adjusted under 35 U.S.C. 154(b) by 35 days.

(21) Appl. No.: 14/695,748

(22) Filed: Apr. 24, 2015

(65) Prior Publication Data

US 2016/0202025 A1 Jul. 14, 2016

(30) Foreign Application Priority Data

Nov. 17, 2014 (UY) ..... 35.838

(51) Int. Cl.

| | |
|---|---|
| ***F41A 17/00*** | (2006.01) |
| ***F41H 13/00*** | (2006.01) |
| ***F41A 17/06*** | (2006.01) |
| ***F41H 9/10*** | (2006.01) |

(52) U.S. Cl.
CPC ..... *F41H 13/00* (2013.01); *F41A 17/00* (2013.01); *F41A 17/063* (2013.01); *F41H 9/10* (2013.01)

(58) Field of Classification Search
CPC ..... F41H 13/00; F41A 17/063; F41A 17/06
USPC ..... 89/1.11
See application file for complete search history.

(56) References Cited

U.S. PATENT DOCUMENTS

| | | | | |
|---|---|---|---|---|
| 4,682,435 | A | 7/1987 | Heltzel | |
| 6,711,844 | B2 * | 3/2004 | Rumfelt | F41A 17/063 42/70.11 |
| 2002/0112390 | A1 | 8/2002 | Harling et al. | |
| 2002/0174589 | A1 * | 11/2002 | Rumfelt | F41A 17/063 42/70.11 |
| 2005/0115386 | A1 * | 6/2005 | LaFata | F41A 17/08 89/1.11 |
| 2006/0042142 | A1 * | 3/2006 | Sinha | F41A 17/063 42/1.01 |
| 2011/0119979 | A1 * | 5/2011 | Gussalli Beretta | F41A 19/01 42/1.02 |
| 2012/0297654 | A1 * | 11/2012 | Williams | F41A 17/063 42/1.01 |
| 2014/0173961 | A1 | 6/2014 | Goren et al. | |
| 2014/0215882 | A1 | 8/2014 | Milde, Jr. | |
| 2014/0250753 | A1 | 9/2014 | Karmanov Kotliarov et al. | |
| 2015/0247704 | A1 * | 9/2015 | Levilly | F41G 3/142 89/132 |

FOREIGN PATENT DOCUMENTS

| | | |
|---|---|---|
| WO | 98/01715 A1 | 1/1998 |
| WO | 99/47878 A1 | 9/1999 |
| WO | 2010/039111 A1 | 4/2010 |

OTHER PUBLICATIONS

Daniel G. J. NEw Nanotect Set to Track, Seld-Destruct, and GPS Tag guns wirelessly; Aug. 11, 2013.*
European Search Report (ESR) dated Mar. 31, 2016 for EP Application No. 15 16 9099.

* cited by examiner

*Primary Examiner* — Joshua Freeman
(74) *Attorney, Agent, or Firm* — Ladas & Parry LLP

(57) ABSTRACT

A device located in a firearm which allows the destruction of the firearm or the incapacitation of the user, in order to avoid the use of such firearm by illegal organizations.

9 Claims, 4 Drawing Sheets

FIREARMS LOCALIZATION AND DESTRUCTION SYSTEM

FIELD OF THE INVENTION

The current invention relates to the field of firearms, more particularly the security mechanisms related to firearms.

BACKGROUND OF THE INVENTION

A current problem today is the misuse of firearms by criminal organizations. These criminal organizations operate armed and constitute a security risk for the public.

In all criminal organizations that could be cited, probably terrorist organizations are the most dangerous of all. They constitute well armed organizations that are not hesitant to use their firearms against defenseless people. It is therefore essential to ensure that the terrorist can not use the firearm or should he use it, that he can be disabled permanently or long enough to be caught by the authorities.

One way to reduce the risk of firearm misuse is the use of security mechanisms. There have been several patent applications addressed to achieve this goal.

U.S. Pat. No. 4,682,435 discloses a mechanism to disable a firearm remotely. The mechanism allows the firearm to be disabled and re-enable it if desired, but not acting on the user, whereby the user could continue using a second firearm, which would allow a terrorist to continue operating simply by changing the firearm or opening the firearm to disable the mechanism.

The US20020112390 application shows a mechanism for locking a firearm when it is being used by unauthorized persons. As in the previous case, this action does not prevent the offender to continue operating with another firearm nor does it prevent the offender to open the firearm and deactivate the mechanism. This system is not suitable for counterterrorism operations.

WO2010039111 application shows the application mechanism to disarm and immobilize an offender by applying a high voltage electrical current. The security system is operated remotely. Nevertheless, incapacitation of the offender is only temporary and the offender could open the firearm to deactivate the mechanism, whereby the system is not suitable for counterterrorism operations.

Therefore it is necessary to dispose of a firearm deactivation system that prevents a terrorist to continue operating after the firearm has been deactivated and also to prevent the firearm to be opened by unauthorized persons, with the aim of disassembling the inactivation mechanism.

BRIEF DESCRIPTION OF THE INVENTION

An object of the invention is a firearm with a system that disables the firearm and/or the offender who intends to use it, so that the offender cannot continue acting after the activation of the security mechanism.

Another object of the invention is a firearm that has built a system that prevents the firearm from being opened by unauthorized persons.

A further object of the invention is a firearm that has a transmission system to establish its location at any time, for the purpose of knowing the location of the offender carrying the firearm.

DETAILED DESCRIPTION OF THE INVENTION

Figure 1:
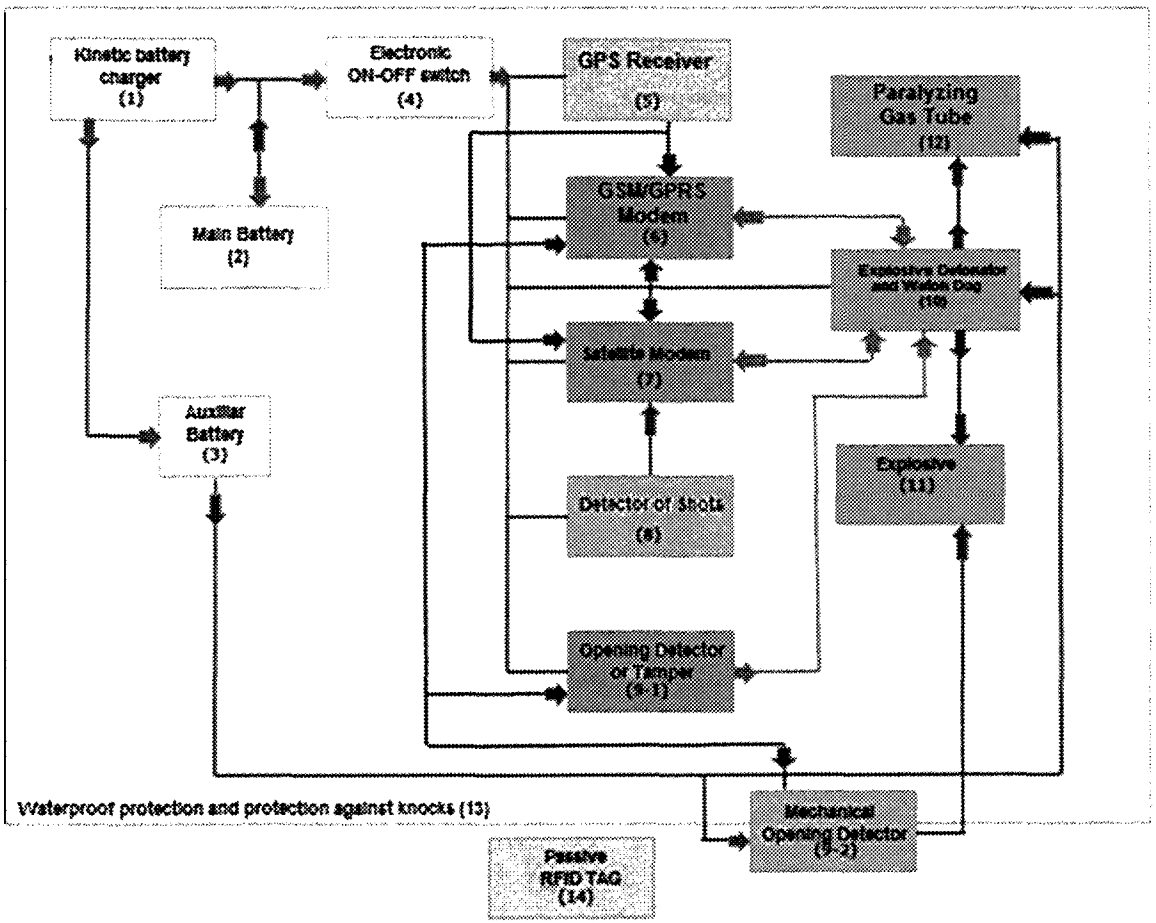
FIG. 1 is a diagram of blocks showing the components of a device according to the invention.

The invention relates to a firearm characterized by comprising:

a—at least one battery b—at least one device for detecting the position of the unit, c—at least one device for transmitting the position of the unit to a remote location, and to receive commands from said remote location, d—a device that sends the signal of detonation to the explosive or the signal of gas release to the cylinder of the paralyzation gas, e—an explosive and f—optionally a cylinder containing paralyzing gas, wherein said explosive and said paralyzing gas cylinder can be activated remotely.

Activation of the explosive, implies detonation, through any kind of detonator; activation of the paralyzing gas cylinder implies the release of the paralyzing gas in the cylinder through any suitable means to this end.

The term GPS corresponds to Global Positioning System.

The term GPRS corresponds to General Packet Radio Service via Radio.

The term GSM corresponds to Global System for Mobile Communications.

The term RFID corresponds to Radio Frequency Identification. The term Tag RFID refers to RFID tags, ie tags that can transmit the identity of an object using radio waves.

The batteries to be used may be any type of known batteries. The use of high performance batteries is preferred. Particularly preferred are lithium ion batteries or lithium-air batteries.

Preferably, at least one of the batteries will be charged using a charger powered by motion (kinetic battery charger). Thus, changing the location of the firearm or its shot will be used to keep the batteries charged.

Any device capable of detecting the position of the firearm could be used. For reasons of precision, the use of a GPS unit is preferred. The accuracy of the location detected by those GPS unit will depend on the number of satellites that transmit signals: a greater number of satellites implies a more precise location.

The mechanism for transmitting the position to a remote location or to receive commands from a remote location may be any known transmission mechanism, operating in a predetermined electromagnetic frequency. For example, a GSM/GPRS modem or a Satellite modem can be used. Preferably, both modems will be used so that if it is possible to use GPRS, which is an extension of the GSM networks used for voice communication, the latter is preferred, while if the firearm is in an area without cellular coverage, the satellite network is used.

Preferably, messages of positions transmitted from the GSM modem unit will be encoded (encrypted). The encoded messages will be decoded in the Control Center.

Preferably, the software design of the micro GSM modem unit will be of a non-blocking and non-attackable type, making it immune to any computer attack that can be recorded via the GPRS network.

To detonate the explosive from a remote location or to release gas from a remote location, a device will send a signal to the explosive or the gas releasing valve. Such a device will receive a signal from the GSM/GPRS modem or the satellite modem which, in turn, have received the detonation or gas release command from the remote location. Upon receiving the signal from the modems mentioned, the device sends an electrical signal to the explosive or gas valve, which produces detonation or the release of paralyzing gas.

The explosive used may be any known high-power explosive. For reliability and security management purposes, the use of C4 is preferred. Obviously, there must be some element that detonates the explosive.

To detonate the explosive, any type of detonator appropriate with the explosive can be used, although for reliability reasons, an electronic detonator is preferred.

The paralyzing gas must be a gas that allows the user to quickly paralyze the firearm user. Any known paralyzing gas can be used. Examples of paralyzing gases are Sarin, Tabun and Soman.

It is preferred that the paralyzing gas is released by detonating an explosive valve so as to achieve a rapid gas release. Preferably, the gas outlet will be located somewhere in the firearm that is not easily visible and is difficult to block. It is preferred that the gas outlet is located behind the trigger system.

Optionally, the device will have an Electronic ON-OFF switch to suppress power consumption when the firearm remains stationary, in order to maximize battery power.

Optionally, the device will have a shot detecting element, in order to transmit to a remote location if the firearm is fired.

Optionally, the device will have at least one opening detector designed to send an electrical signal to detonate the explosive if an unauthorized firearm opening occurs. In that case, when an authorized opening is to be performed, it is possible to deactivate sending the electrical firing signal with an appropriate code, which can be sent from a remote location.

Preferably, the firearm will have a device that allows traffic control of the firearm, so as to detect the movement of firearms across borders, airports, restricted areas, etc. Devices of this type are, for example, RFID Tags. It is preferred that the device is a passive RFID Tag.

The entire system will be located preferably in at least one casing protecting it from water or moisture and knocks and is thermally insulated. In some cases, all system components can be located in a single casing located in a suitable area of the firearm, for example in the butt. In other cases, the components can be divided into more than one casing, each casing located in different parts of the firearm, for example in the butt and the grip.

The signal emitted by the firearm will be sent to a remote location. The device also receives signals sent from a remote location.

Preferably, the remote location is a Control Centre that will permanently monitor the position of the firearm and will be responsible for making decisions regarding the possible destruction of the firearm or the possible release of the paralyzing gas.

The device components can be located all on the same area of the firearm or distributed over one or more different zones. For handguns, the size of the firearm makes its location preferred in the same area of the firearm, such as its butt. In the case of long guns that have a butt and a handle (mango), it is possible to divide the components of the device between the butt and the handle, so as to facilitate their insertion into the long gun.

In cases where any electric signal to be transmitted among components and these components are not in contact, these components should be linked by means of electric cables. Electric cables can be of any known type and compatible with the function to be performed, but are preferred to cover the smallest section as possible, in order to decrease the total volume of the device. The expert will have no difficulty in uniting those components that require an electronic signal; choosing the most suitable type of cable is also evident for the expert.

Figures are described in detail so as to exemplify the invention. Figures are shown and described by way of a preferred embodiment and do not in any way limit the invention.

FIG. 1 is a diagram of blocks of a device according to the invention. The device consists of different modules, and they are described. The red lines in the diagram are DC power lines. The lines are blue and the Data buses are light blue, which allow communication between modules.

Module 1 (1) is the kinetic battery charger. This technology harnesses the kinetic energy of motion for recharging batteries and is currently used for charging smartphones, which has proved its efficiency. This charger has the maximum capacity that can be obtained based on space available in the firearm to house it.

The kinetic charger will activate automatically each time the firearm is moving. This system, in combination with the electronic switch that lowers the minimum sustainable consumption of battery power, in conjunction with the lithium ion battery, makes the firearm localization system have a wide range of reliable autonomous performance. In case of a failure in the GPS/GPRS system power supply, the redundant RFID passive system which needs no power to operate, will allow the tracking of the firearm in the areas in which RFID readers are available (Borders, Airports, etc.).

Preferably, the kinetic battery charger, will also use the energy released during the shots, to charge the battery.

Module 2 (2) is the main battery. The autonomy of the solution is given by the capacity of the batteries and the kinetic charger, both elements directly related to the Electronic ON-OFF switch that lowers power consumption to a minimum when the firearm is not in movement. The use of lithium ion or lithium-air batteries is preferred. Especially preferred are lithium-air batteries.

Module 3 (3) is the auxiliary battery. The device has a second battery for high performance and lower capacity, whose main function is to provide redundant power to Module 10 (Explosive Detonator) and the explosive itself (Module 11).

This battery will be the contingency in case of failure of the main battery. It will also ensure the destruction of the firearm in case the global positioning systems do not work and the firearm is opened to disable the mechanism. The auxiliary battery technology will be preferably lithium ion or lithium-air. Especially preferred is a lithium-air battery.

The power consumption of the auxiliary battery while the system is operating normally will be normally nonexistent and the recharge of this battery will be obtained from the kinetic battery charger.

Module 4 (4) is the Electronic ON-OFF switch. The Electronic ON-OFF switch comprises an accelerometer and a chip with software that allows to process the motion information detected by the accelerometer and thus carry out the ignition system or its switching off.

The function of this module is to ensure that no unnecessary battery power is consumed and increase the life of the battery when the firearm remains still. The Electronic ON-OFF switch will be responsible for suppressing the battery consumption when the firearm does not change position. This will allow greater autonomy of the internal battery system.

When the firearm is not in motion, the only energized module is the Electronic ON-OFF switch, thus giving power to the other modules when it detects movement of the firearm.

Once the firearm is set in motion, the automatic electronic switch of motion detection (composed of an accelerometer) will trigger the system to begin transmitting the GPS location of the firearm, the positioning messages will be sent according to the configured intervals. The motion detection system is of very low power consumption to enable an extended battery life, because the system will not transmit the firearm position via GSM/GPRS or Satellite and therefore will not involve significant energy consumption.

In the Control Center, there will be preferably a historical record in which the last position reported by the GPS/GPRS firearm system before becoming still will be saved.

Module 5 (5) is the GPS receiver unit. This unit is preferably a microdrive GPS receiver which receives satellite signals, eg satellite defense signals.

The purpose of the GPS unit is to determine the position of the firearm at any time. The accuracy of the positioning will be based on the number of satellites that can be received in the GPS antenna. Upon receiving signals from four satellites, an accuracy between 10 and 15 meters is estimated, achieving higher precision (about 3 meters) when the receiver receives signals from a greater number of satellites.

Through the Data Bus, a GPS unit transmits the geographic location information to the GSM/GPRS Modems (Module 6) and Satellite (Module 7). This information will be processed by both modules and transmitted to the control center via the medium of transmission available.

In areas where there is GSM coverage, the transmission will be performed by the GSM Modem and the Satellite Modem will not make any transmission, so that the battery power is preserved.

In areas where there is no GSM coverage (Cellular Networks), the transmission control center will be conducted by the Satellite Modem (Module 7).

Module 6 (6) is the GSM/GPRS modem that enables the transmission of the positioning of the firearm to the Control Center.

For the transmission of the positioning of the unit to the Control Center, the use of the existing Cell Phone Network is preferred, which allows excellent coverage in cities, although it presents some coverage difficulty outside them. Good coverage in cities allows the positioning unit to transmit with lower power and this results in a low power battery consumption.

To minimize the size of the GSM Modem unit, it is possible to make an agreement with the providers of cellular telephony, so that implantation of a chip into the unit is not required and so that the unit is already configured automatically for start up once it is set in motion.

The GSM Modem allows the transmission of the location of the firearm and the reception of the command from the Control Center to activate the destruction mechanism.

The GSM/GPRS module through the Data Bus Module communicates with the Module (Explosive Detonator) to send the destruction command if the command is received from the Control Center.

Power for the operation of this module is obtained from the Main Battery system. In the absence of cellular network coverage, the contingency system transmits to the Control Center via the Satellite Modem. It is preferable that the Satellite Modem also uses an encrypted communication protocol.

Module 7 (7) is the Satellite modem, which allows the transmission of the position of the firearm in places where there is no coverage of GSM Cellular Networks and enables the reception of the destruction command from the Control Center.

The Satellite modem demands a higher energy consumption for its transmission to the GSM/GPRS modem, for that reason, in areas where there is no cellular network coverage, the system preferably will only send positioning data of the firearm through the Satellite solution when the firearm is fired. The Satellite modem will receive the destruction command from the Control Center and via the Data Bus it will send the command to the Explosive Detonator (Module 10) which will trigger the explosive.

The Satellite modem is powered by the Main Battery, it receives information of the geographical position through the Data Bus which connects it to the GPS receiver and sends the destruction command to the Explosive Detonator Module.

Module 8 (8) is the Shot Detector module. This module comprises an accelerometer and a chip with software and its main function is to inform the Satellite modem that the firearm has been fired. When the accelerometer detects the recoil due to a shot, the software communicates that the firearm was fired by the Data Bus to the Satellite modem and GSM/GPRS modem which, in turn, report to the Control Center. This module is powered by the Main Battery.

Module 9-1 (9-1) is the Opening Detector or Tamper, while the Module 9-2 (9-2) is the Mechanical Opening Detector. The function of these modules is to prevent unauthorized opening of the device.

Module 9-1 is powered by the Main Battery and redundantly by the Auxiliary Battery which will enable the detonation of the firearm in places where no GSM/GPRS and Satellite coverage exists for cases where the firearm is opened.

It communicates via the data bus directly with the Explosive Detonator (Module 10).

If module 9-1 detects an unauthorized opening of the firearm, immediately and without a confirmation command by the Control Center, the firearm will be destroyed.

In the manufacturing process of the firearm, the Opening Detection device remains inactive. When the firearm is ready to be dispatched, the activation command of the Opening Detector Module is sent via the GSM/GPRS Modem, and it will remain active until it becomes deactivated again with the correct procedure and via GSM/GPRS.

This functionality will enable the activation or deactivation of the opening destruction system with approved maintenance purposes.

The deactivation command of the opening Detector or Tamper may only be carried out from the Control Center by the owner and encrypted protocol, using the owner and encrypted protocol, it will be possible to verify that indeed the module was activated successfully.

The solution includes an Opening Detector or mechanical tamper (Module 9-2), which only requires power from the auxiliary battery to activate the explosive in case the positioning system is damaged or not active due to lack of energy from the main battery.

The Mechanic Opening Detector comprises a micro-switch which is mechanically activated when trying to open the firearm in an unauthorized manner. In said cases where the firearm is opened in an unauthorized manner, Module 9.1 is not blocking the Mechanic Opening Detector because it has not received the command by the Control Center enabling the safe opening of the device. In that case, the micro-switch is mechanically actuated and immediately sends an electrical pulse to the plastic explosive, which causes the destruction of the firearm and the person who tried to disarm the system.

When an authorized opening of the firearm is going to be carried out, the Control Center sends the command via Satellite modem or GSM/GPRS modem so that the firing of the plastic explosive does not occur, although the mechanical micro-switch is activated. Thus the device can be opened safely.

Preferably, the mechanical tamper will be resistant to knocks and detonations of the firearm, in order that it is activated only if someone tries to disarm the device.

Module 10 (10) is the Explosive Detonator and "Watch Dog". The explosive Detonator Module draws power from the Main Battery and the Auxiliary Battery, increasing the system's reliability to ensure destruction of the firearm if required by the Control Center. Simultaneously, this module controls the firing of the paralyzing gas only when the elimination of the user and not the firearm is required by the Control Center Through the Data Bus, this Module communicates with the GSM/GPRS Modem, the Satellite Modem and the Opening Detector or Tamper. Through the Data Bus, the Explosive Detonator Module receives the destruction command from the Control Center or the module that detected the opening of the firearm.

After receiving the command, it immediately fires the plastic explosive charge to destroy the firearm and its user or the opening of the paralyzing gas tube is triggered enabling an immediate emanation of its content.

The Detonator Module of explosives includes a "watch dog" system that controls the functioning of the entire set of modules, in order to avoid erratic shots that may cause the destruction of the firearm and its user when it is not desired. The "watch dog" system is a safety mechanism commonly used in electronic equipment and is responsible for verifying that all the programs that make up the different modules are active and without blockages. Communication with the different modules is performed through the Data Bus.

Another preferred function of the "watch dog" is to request confirmation of the order of detonation of the explosive or the activation of the gas. When the command of detonation of explosives or gas activation is received from the Control Center via GSM/GPRS modem or Satellite modem, the "watch dog" system will respond with a request for confirmation of the order, which will be sent to the Control Center via the modem that is active.

Module 11 (11) is the Explosive. Any high-power explosive (de alta potencia) is suitable. Plastic explosives are preferred. Especially preferred is C4, due to its stability and reliability.

C4 also has the advantage of being mouldable, adapting well to the spaces available, it does not explode if it is hit (even by a bullet), perforated, cut or thrown into the fire.

The command of explosion could be provided by electric and non-electric detonators, but it will preferably be given by an electronic detonator (Modulo 10) that provides security and prevents erratic shots.

Module 12 (12) is the Paralyzing Gas Tube. The function of this tube is to destroy the firearm user, but not the firearm itself. To this end, a fast acting paralyzing gas will be used. Nonlimited examples of these gases are Sarin, Soman and Tobrun.

The release of gas is performed in this case by detonating an explosive valve installed on the gas tube or container in order to achieve a quick emanation.

To avoid blockage of the paralyzing gas emanation tube, the tube is located at a point in the firearm that can not be blocked and that it is hardly visible. Especially preferred is the area behind the trigger.

Control of the firing of the paralyzing gas tube will be performed by Module 10, which is also responsible for the detonation of the plastic explosive, if required. Energy for microdetonation of the gas release valve shall be provided by the Auxiliary Battery.

Whereas the paralyzing gas can be fired in open areas, it is preferred that the concentration of gas inside the tube is such that, when released in an open space, it allows the firearm user to be eliminated within a 5 meter perimeter.

To ensure the system operation even under adverse conditions, the device must be in a waterproof casing (13). It is preferred that the casing resists an immersion of up to 10 meters. Said casing protects the modules comprising the system's destruction of elements, such as water and dust, so as to increase the system's survival and reliability.

Preferably, the device is thermally insulated, so it can operate reliably in hot places.

Module 14 (14) is the passive RFID Tag. Adding a RFID Tag to the metal structure of the firearm, allows the control of firearms traffic across borders or places controlled through RFID. This passive system is a contingency that can detect the movement of firearms and acts if the system of firearm destruction is damaged or powerless.

RFID technology enables identification through RFID from a Transmitter-Receiver that requires no direct vision with RFID Tag. The Tag is implanted in the metal structure of the firearm.

The passive RFID does not consume battery power, thus allowing to determine the location of a firearm when the GPS receiver of the firearm does not receive satellite signals nor when it cannot transmit via GPRS or Satellite. This second element of the solution of the positioning of the firearm increases the survival of the system and guarantees the location of a firearm in a fenced area even when it does not have signal or battery power. Each firearm will have its own code or associated ID that can identify it and distinguish it.

In protected or fenced areas, it is possible to implant Transmitter-Receiver antennas for RFID, which will enable to identify the location of firearms in the area. The wider the coverage of RFID antennas, the more accurate the location of firearms inside buildings or places where the GPS signal is received will be.

Further, the passive RFID system allows the location of a firearm that is submerged in water. In this case, a portable and high gain RFID antenna is sufficient for the search.

Figure 2:
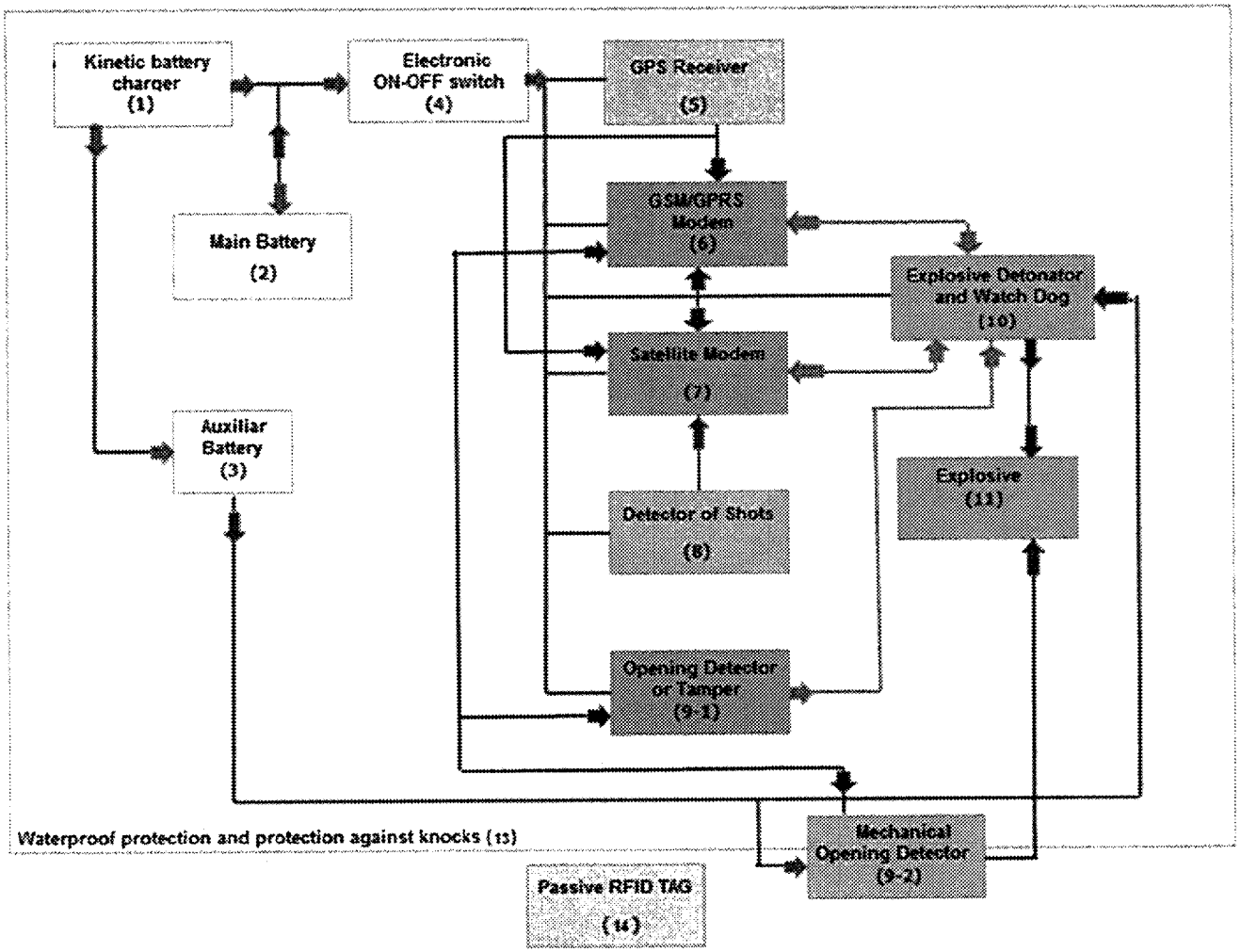
FIG. 2 is a diagram of blocks showing the components of another device according to the invention.

FIG. 2 is a diagram of blocks of a device according to the invention in which the paralyzing gas cylinder is not incorporated. The rest of the modules are similar to those of FIG. 1.

Figure 3:
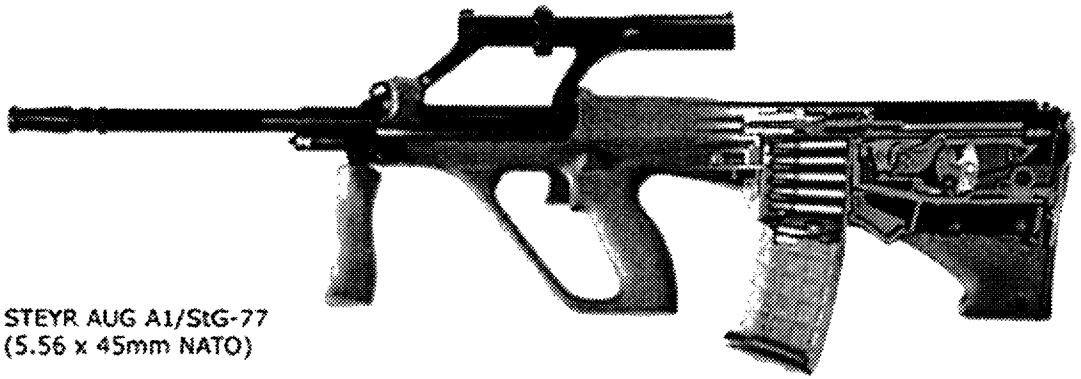
FIG. 3 is a photograph of an assault rifle used to illustrate the location of the components of the device of the invention.

FIG. 3 is a photograph of an assault rifle STEYR AUG A1/SIG-77, chosen to illustrate a possible location of the device components in a firearm.

Figure 4:
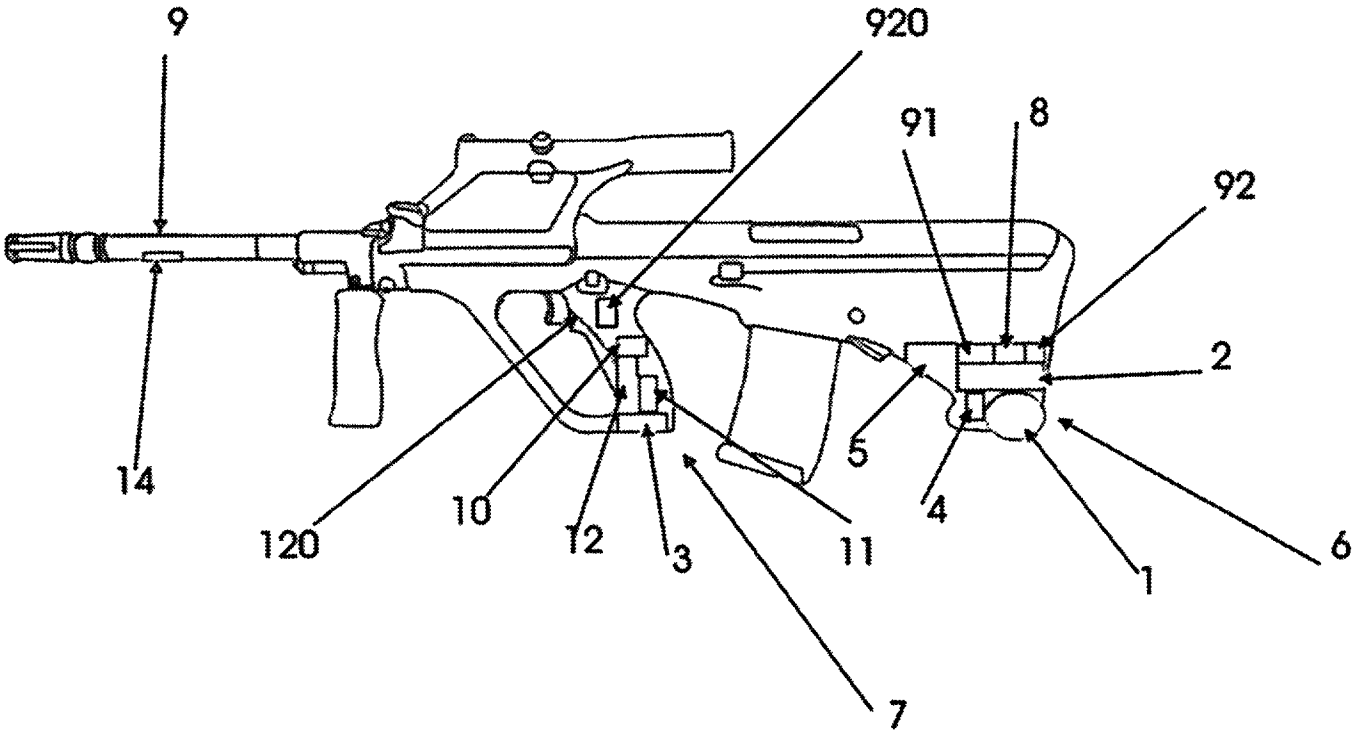
FIG. 4 is a diagram showing the location of the components of a device according to the invention on the rifle shown in FIG. 3.

FIG. 4 shows the location of the device components in the assault rifle of FIG. 3. It is appreciated that the components are divided into two areas of the firearm in this example.

In the area of the butt 6, the kinetic battery charger 1, the main battery 2, the electronic ON-OFF switch 4, an integrated module 5 containing the GPS receiver, the GSM/GPRS modem and the satellite modem, the shot detector 8, the opening detector or tamper 91 and the mechanical opening detector 92.

In the area of the handle 7, the auxiliary battery 3, the explosive detonator and "watch dog" 10, the explosive 11, the paralyzing gas tube 12 with its gas outlet tube 120 and a second mechanical opening detector 920.

Two mechanical opening detectors 92 and 920 are present because a firearm user could try to open in an unauthorized manner both the butt 6 and the handle 7.

All components found in the butt 6 and the handle 7 are surrounded by a waterproof protection and a protection against knocks, not shown for clarity reasons. Moreover, said components are connected by cables when it is required for sending electric signals between various components.

In the area of the gun barrel 9, the passive RFID Tag 14 is installed.

The entire device can be installed in any type of firearm, be it a handgun or a long gun. Obviously, a handgun will require that the device components are smaller or that they occupy a larger portion of volume of the firearm for installation.

Since the volume occupied by the components of the device must be the smallest possible, all components of the device are preferably selected for their high performance and low power consumption, so as to minimize its size.

The invention claimed is:

1. A firearm, comprising:

a—at least one battery, b—at least a kinetical battery charger connected to at least one battery, c—at least one device for detecting a location of the firearm, d—at least one device for transmitting the location of the firearm to a remote location, and for receiving a command from said remote location, e—an explosive, f—a cylinder containing paralyzing gas, and g—a device that sends an electrical signal of detonation to the explosive or an electrical signal of gas release to the cylinder containing the paralyzing gas, wherein said explosive and said cylinder containing the paralyzing gas can be activated remotely.

2. The firearm according to claim 1, wherein the device detecting the location of the firearm is a GPS unit.

3. The firearm according to claim 2, wherein the device for transmitting the location of the firearm and for receiving a command comprises a GSM/GPRS modem.

4. The firearm according to claim 2, wherein the device for transmitting the location of the firearm and receiving a command comprises a satellite modem.

5. The firearm according to claim 2, wherein the device for transmitting the location of the firearm and for receiving a command comprises a GSM/GPRS modem and a satellite modem.

6. The firearm according to claim 5, wherein said firearm comprises at least one mechanical opening detector that sends an electrical signal that detonates the explosive when an unauthorized opening of the firearm occurs.

7. The firearm according to claim 6, wherein said firearm comprises an opening detector module which controls the opening detector mechanical opening and blocks the electrical signal which detonates the explosive, when an authorized firearm opening occurs.

8. The firearm according to claim 7, wherein said firearm comprises a device for detecting shots.

9. The firearm according to claim 8, wherein said firearm comprises a passive RFID tag.

* * * * *